United States Patent [19]

Whiteside

[11] Patent Number: 4,505,389

[45] Date of Patent: Mar. 19, 1985

[54] PACKAGE ASSEMBLIES

[76] Inventor: Michael G. Whiteside, 5200 Dixie Rd., Ste. 118, Mississauga, Ontario M4W 1E4, Canada

[21] Appl. No.: 569,638

[22] Filed: Jan. 10, 1984

[51] Int. Cl.[3] ..... B65D 73/00

[52] U.S. Cl. ..... 206/460; 206/807

[58] Field of Search ..... 206/460, 497, 807

[56] References Cited

U.S. PATENT DOCUMENTS

| | | | |
|---|---|---|---|
| 3,542,193 | 11/1970 | Hewlett | 206/497 |
| 3,878,943 | 4/1975 | Ryan et al. | 206/497 |
| 3,885,671 | 5/1975 | Spiegel et al. | 206/460 |
| 4,050,579 | 9/1977 | Gorski et al. | 206/460 |
| 4,055,249 | 10/1977 | Kojima | 206/460 |
| 4,304,332 | 12/1981 | Danti | 206/497 |

FOREIGN PATENT DOCUMENTS

| | | | |
|---|---|---|---|
| 2387172 | 11/1978 | France | 206/497 |

*Primary Examiner*—Stephen P. Garbe

*Attorney, Agent, or Firm*—Robert F. Delbridge; Arne I. Fors

[57] ABSTRACT

A package assembly has a rigid base member with at least one pair of parallel lines of weakening defining a tear strip. At least one row of packages is positioned on the base member and removably secured to a tear strip by frangible adhesive. A film of plastic material passes over the packages and is secured to the base member to retain the packages in assembly therewith. The packages are removable from the assembly by removing the plastic film, tearing the tear strip from the remainder of the base member, and separating the packages from the tear strip by breaking the frangible adhesive.

7 Claims, 11 Drawing Figures

PACKAGE ASSEMBLIES

Figure 1:
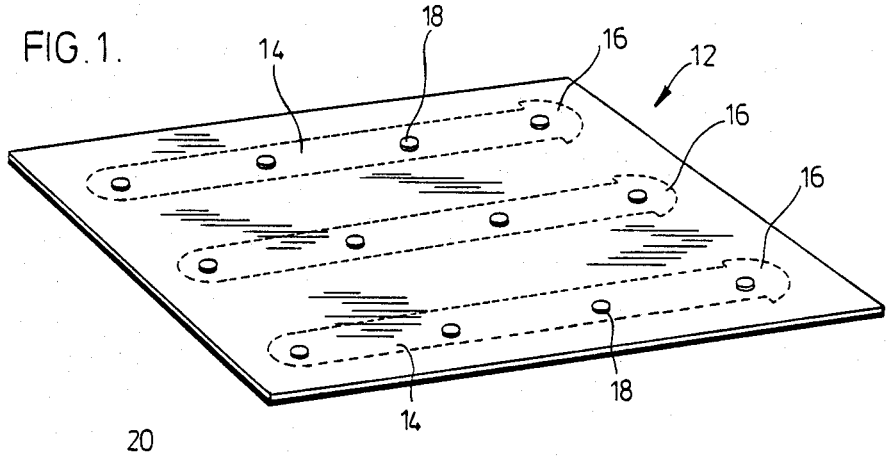

This invention relates to package assemblies which enable a number of packages to be transported as a single unit from the package manufacturer or filler to a place where the packages are required.

There are many instances where such package assemblies would be useful. For example, in the food industry, food of various kinds is packages in various different types of packages, such as cans or cartons of circular or rectangular section. For many years, it has been the conventional practice to transport such packages from the manufacturer to a retail outlet in cardboard boxes, and a considerable amount of expense and labour is incurred in the packing of such boxes by the manufacturer and subsequently unpacking the boxes and arranging the packages on display shelves such as are commonly found in a supermarket. Other packages assemblies have been proposed, but these still involve a considerable amount of expense and labour.

It is therefore an object of the present invention to provide a package assembly which requires less expense and labour in packing and unpacking and which is especially useful in the food industry for transporting packages from the manufacturer to a retail outlet.

According to the present invention, a package assembly comprises a rigid, frangible base member having at least one pair of parallel lines of weakening defining a tear strip, at least one row of packages positioned on the base member and removably secured to a tear strip by frangible adhesive, and a film of plastic material passing over the packages and secured to the base member to retain the packages in assembly therewith, the packages being removable from the assembly by removing the plastic film, tearing the tear strip from the remainder of the base member, and separating the packages from the tear strip by breaking the frangible adhesive.

There may be a plurality of rows of packages, with the base member having a plurality of tear strips, each tear strip extending beneath the respective row of packages. The packages may be removably secured to the base member by spots of frangible adhesive, and the film may provide an imperforate covering the packages to resist entry of dust or dirt.

The base member may be of fibrous material, with the adhesive having a greater adherence to the fibrous material than to the packages to cause substantially all the adhesive to remain attached to the tear strip when the packages are removed therefrom.

The top and/or bottom of the packages may be provided with tamper-evident structure. For example, each package may have superposed folded over portions at the bottom, the lowermost portion having an aperture exposing an adjacent portion and the tear strip having a partially cut-out portion secured by adhesive to the bottom of each package over the aperture, each partially cut-out portion separating from the remainder of the base member when the associated package is separated therefrom and remaining attached to the bottom of the package. The bottom of such a package cannot be opened without destroying the adhesive connection between the cut-out portion and the bottom of the package.

Each package may have superposed folded over portions at the top, an uppermost of said portions having a slot exposing an adjacent portion, a spot of thermoplastic material having been deposited in the slot to engage the adjacent portion and also overlapping at least one side edge of the slot to engage the uppermost portion. The top of such a package cannot be opened without fracturing the spot of thermoplastic material in and around the slot.

Figure 2:
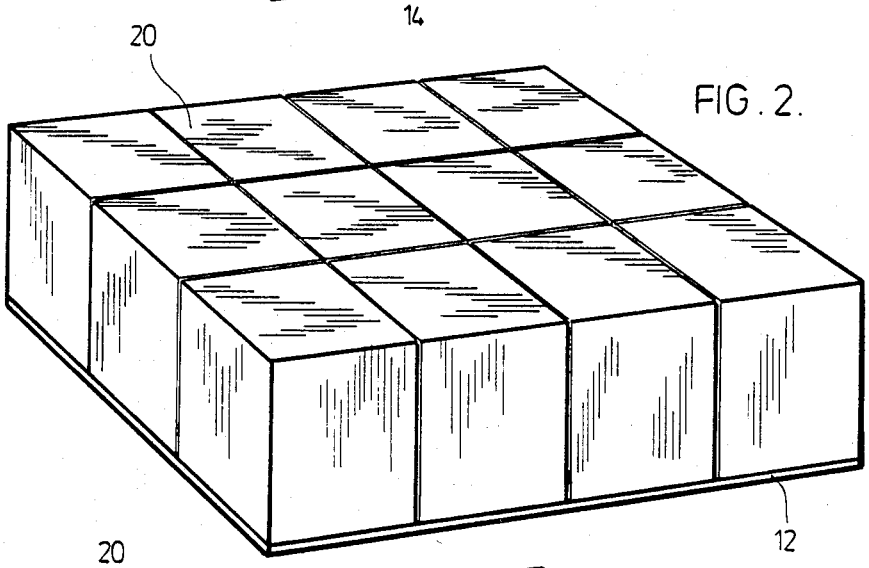
Figure 3:
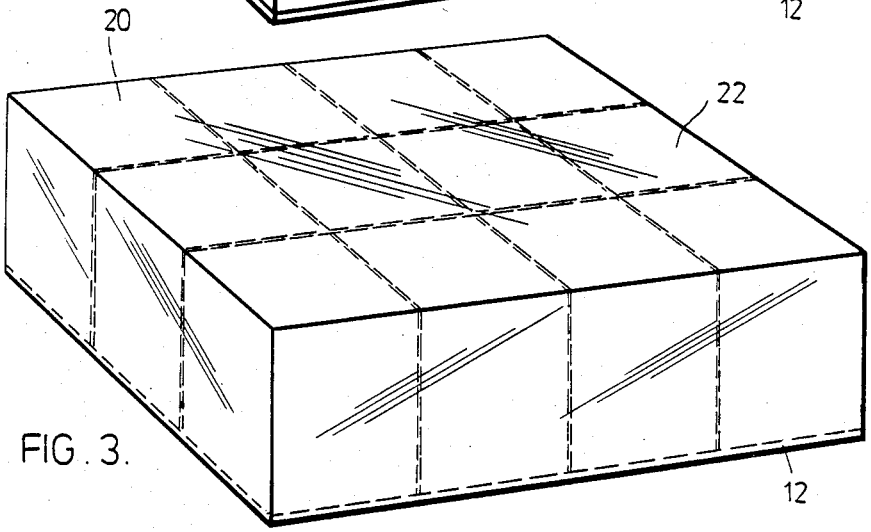
Figure 4:
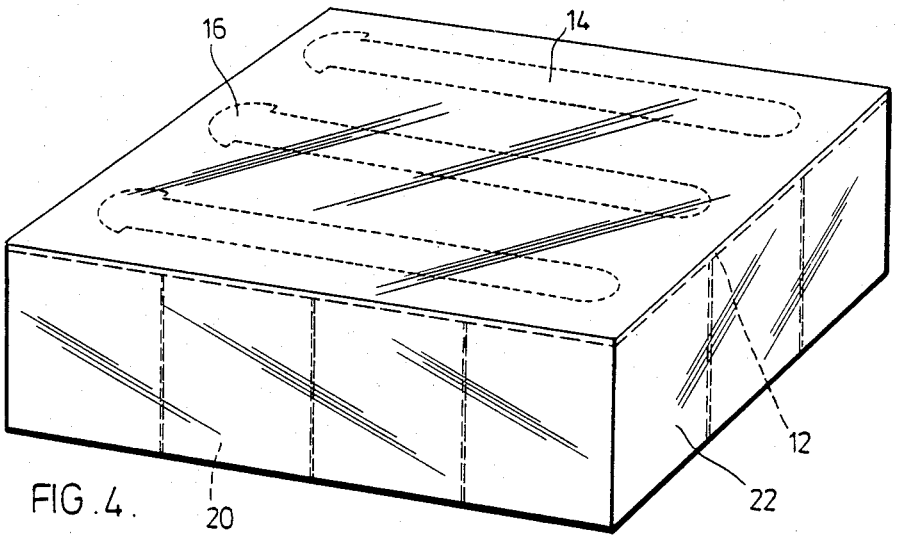
Figure 5:
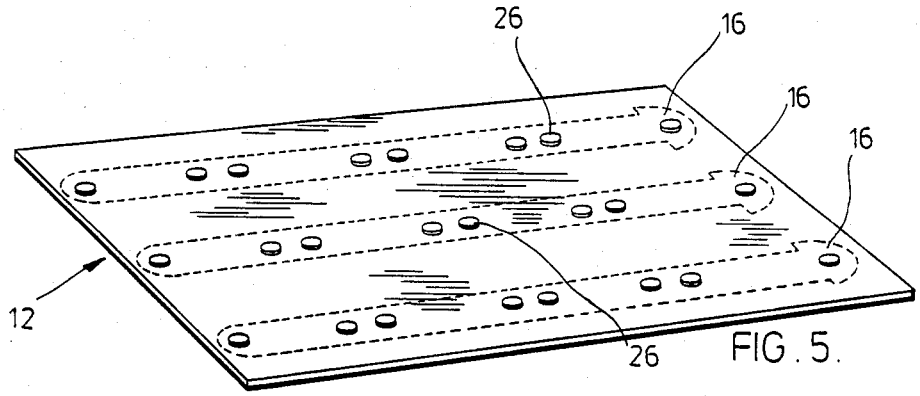
Figure 6:
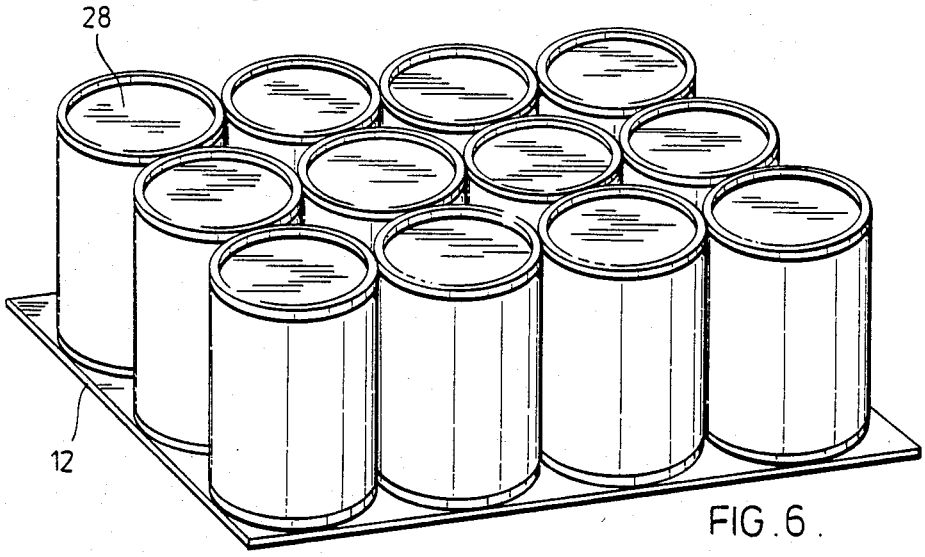
Figure 7:
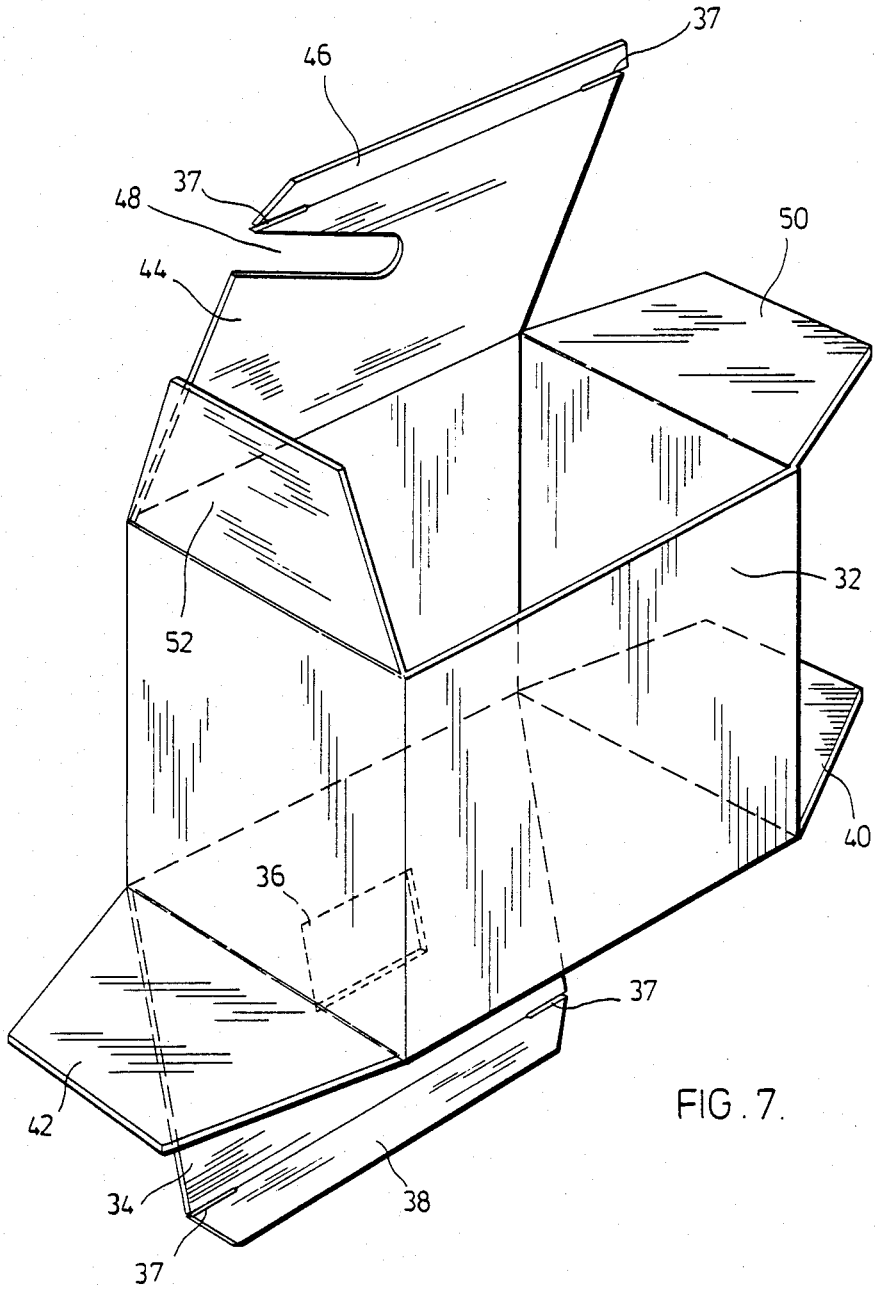
Figure 8:
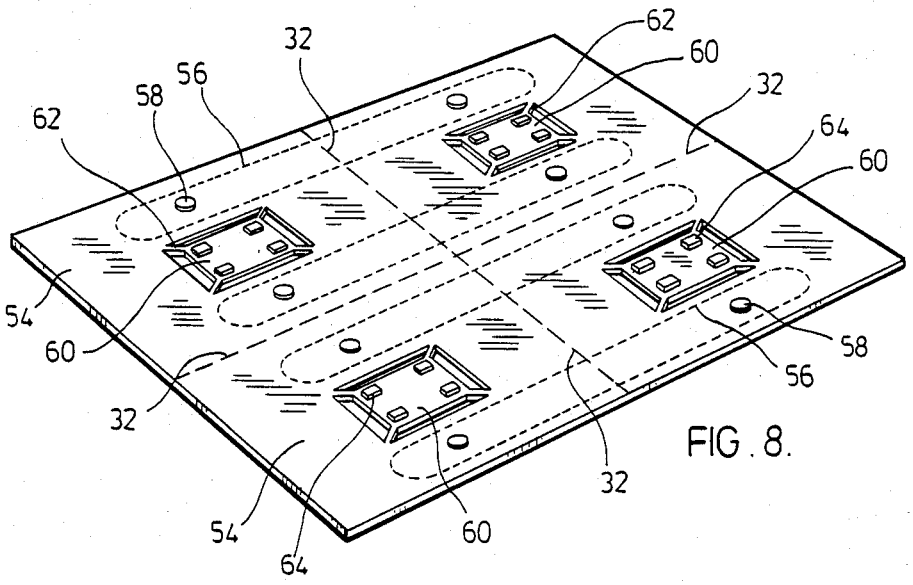
Figure 9:
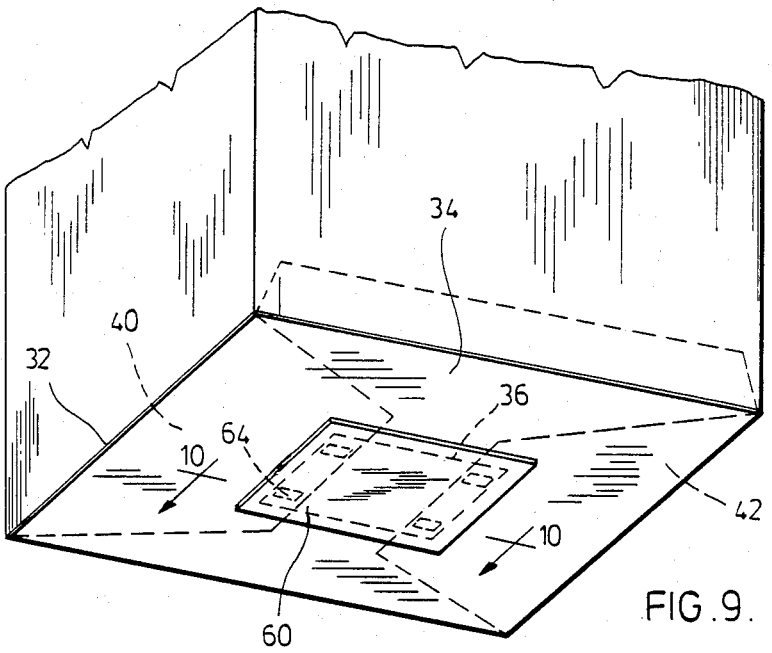
Figure 10:
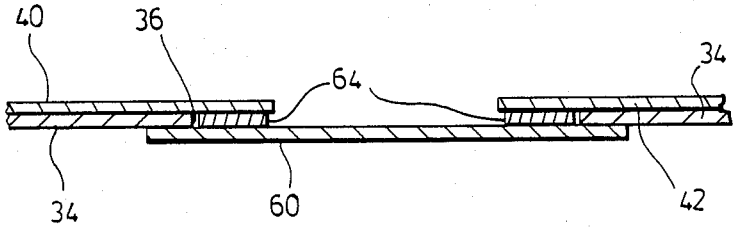
Figure 11:
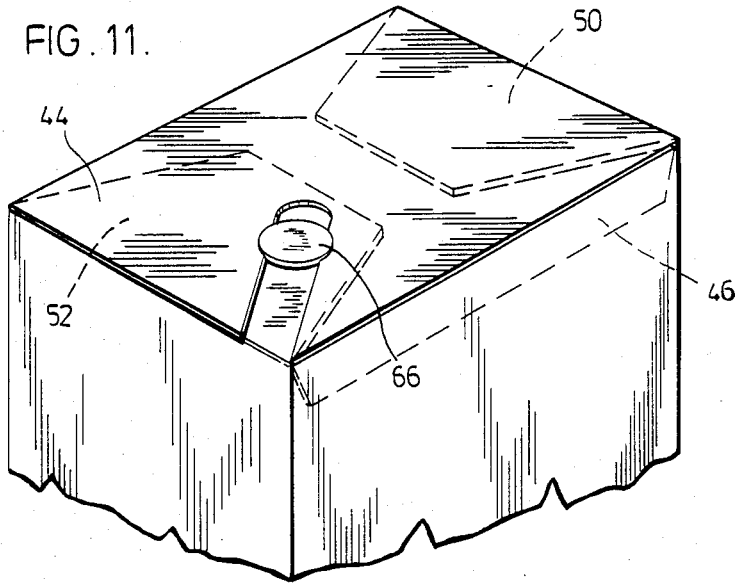

Embodiments of the invention will now be described, by way of example only, with reference to the accompanying drawings, of which:

FIG. 1 is a perspective view of a base member in accordance with one embodiment of the invention, FIG. 2 is a similar view showing packages of rectangular section positioned on the base member, FIG. 3 is a similar view showing a plastic film extending around the packages and secured to the base member, FIG. 4 shows the package assembly of FIG. 3 in an inverted position, FIG. 5 is a perspective view of a base member in accordance with another embodiment, FIG. 6 is a similar view showing packages of circular section positioned on the base member of FIG. 5, FIG. 7 is a perspective view of a package showing tamper-evident top and bottom structure in an open position, FIG. 8 is a plan view of a base member having tamper-evident structure cooperable with the tamper-evident bottom structure of the package of FIG. 7, FIG. 9 is a bottom view of the package after separation from the base member, FIG. 10 is a sectional view along the line 10—10 of FIG. 9, and FIG. 11 is a plan view of the package after closure of the top.

Referring to the accompanying drawings, FIG. 1 shows a base member 12 in the form of die-cut paper board which is rigid yet frangible. The base member 12 has three pairs of parallel lines of weakening, each forming a tear strip 14, and with each tear strip 14 having a tab 16 at one end which has been punched out of the board. The base member 12 has a relatively smooth bottom surface and a rougher, more fibrous upper surface. If desired, appropriate printing may be applied to the smooth bottom surface.

By means of appropriate equipment, the nature of which will be readily apparent to a person skilled in the art, three rows of spots of molten adhesive 18 are applied to the fibrous upper surface of base member 12, with the spots 18 in each row being spaced along a respective tear strip 14. Usually, the adhesive will be applied by applicators situated above a conveyor along which the base member is travelling. The adhesive may be conveniently of the kind commonly known as hot melt.

While the adhesive is still molten, a series of packages 20 of rectangular section are placed in adjacent side-by-side relationship on the base member 12 so as to occupy substantially the whole area of the base member. The packages may for example contain food, and may be cartons or paper packages. Usually, the packages 20 will be positioned on the base member 12 by equipment which feeds the packages in a direction perpendicularly to the direction in which the base member 12 is travelling, and then positions a pre-arranged set of packages on the base member 12 immediately after the adjesive spots 18 have been applied thereto.

As shown in FIG. 2, the packages 20 are arranged in the same number of rows as there are tear strips 14, i.e. three, with each package 20 being positioned over an adhesive spot 18. The adhesive is such that it will adhere to the packages 20 to the extent that the packages 20 are secured to the base member 12 firmly enough to resist movement relative thereto during normal handling, but which can be broken by manual force to separate the packages 20 from the base member 12 when desired.

Referring now to FIG. 3, a plastic film 22 is then passed completely around the packages 20 and secured to the bottom surface of the base member 12 near the edge. The plastic film 22 is arranged to form an imperforate cover over the packages to resist entry of dust and dirt or alternatively may form a tunnel-like wrapping which is open at the ends. Again, the nature of the equipment required for this purpose will be readily apparent to a person skilled in the art.

The resultant package assembly can then be transported conveniently from the manufacturer to a retail outlet such as a supermarket. When the package assembly is at the retail outlet, it is merely necessary to turn the package assembly upside down, as shown in FIG. 4, remove the plastic film 22, and pull each tab 16 to tear the tear strips 14 away from the remainder of the base member 12, with the adhesive spots 18 on each tear strip 14 separating from the packages 20 without tearing fibre from the packages. The remainder of the base member 13 is then removed.

FIG. 5 shows a different manner of positioning adhesive spots 26 which is suitable when the packages are metal cans 28 (shown in FIG. 6). Adhesive spots 26 are positioned in each tear strip 14, and are arranged such that each can 28 engages two adhesive spots 26 which are diametrically opposite on the bottom of the can.

Any convenient number of packages may be positioned on the base member in a single layer, for example six, twelve, twenty-four or thirty-six, and the packages may be of paper, metal or plastic. The packages may be arranged in two layers, before application of the plastic film, and in this case it is preferable for the packages to be shaped in such a manner that there is some interlocking between the bottoms of the packages in the upper layer and the tops of the packages in the lower layer.

The packages and base member may be provided with structure which enables the packages to be tamper-evident, that is to say have structure which indicates when unauthorized tampering with the top or bottom of the packages has occurred. Referring to FIG. 7, the bottom of a package 32 has a bottom panel 34 which is an integral extension of one wall and which has a central rectangular aperture 36. The bottom panel 34 also has a flap 38 which is insertable into the container at the opposite wall. Side flaps 40, 42 are integral extensions of opposed side walls, and are folded across the bottom of the package before the bottom panel 34 when closing the bottom of the package, so that the ends of the flaps 40, 42 appear in the aperture 36. Slits 37 are provided between the bottom panel 34 and flap 38 at the ends to provide locking in the closed position.

The top of package 32 has a top panel 44 which is an integral extension of one wall. The top panel 44 has a flap 46 which is inserted into the package at the opposite wall and also has a slot 48 extending inwardly in a generally diagonal manner from one of the corners of the panel 44 adjacent the flap 46. Side flaps 50, 52 are integral extensions of opposite side walls, and are folded across the top of the package before the top panel 44 when closing the top of the package, so that the slot 48 lies across one of the flaps 50, 52.

As shown in FIG. 8, the base member 54 is of a size to receive four containers 32 and has tear strips 56 positioned so that two strips 56 extend under each container 32. Spots of frangible adhesive 58 are applied to the tear strips 56 immediately before the packages 32 are positioned on the base member 54. The base member 54 also has four rectangular cut-out portions 60 which are severed from the remainder of the base member 54 except at the corners where retaining portions hold the cut-out portions 60 in place. Spots of non-frangible adhesive 64 are positioned on the cutout portions 60 immediately before the packages 32 are positioned on the base member 54. The cut-out portions 60 are arranged to be somewhat larger than the apertures 36 in the bottom panels 34 of the packages 32.

The bottom of package 32 is closed before filling and, after filling, the top of the package 32 is then closed. The adhesive spots 56, 64 are applied to the base member 54 and four packages 32 are placed thereon. The non-frangible adhesive spots 64 on the cut-out portions 60 are positioned so that they will be partly within and partly outside the periphery of the apertures 36 in the bottoms of the packages 32 so that the cut-out portions 60 become adhesively secured to the ends of the flaps 42 and to the bottom panel 34. A spot of thermoplastic material 66 is applied to the top of each package 32, partly in the slot 48 to contact the flap 52 and partly overlapping the edges of the slot 48 so as to contact the top panel 44.

When the resultant package assembly is opened by removal of the plastic film, and each package 32 is separated from the base member 54, each cut-out portion 60 remains attached to the associated package 32 and breaks away from the remainder of the base portion 54, with fracture of the retaining portion 62. The bottom of the removed package 32 is shown in FIGS. 9 and 10. The bottom of the package 32 is consequently tamper-evident since the bottom cannot be opened without destroying the adjesive connection between the cut-out portion 60 and the package itself. Similarly, the top of the package 32, as shown in FIG. 11, is also tamper-evident since it cannot be opened without destroying the adhesive connection between the thermoplastic spot 66 and the panel 44 and flap 52.

Other embodiments of the invention will be readily apparent to a person skilled in the art, the scope of the invention being defined in the appended claims.

What we claim as new and desire to protect by Letters Patent of the United States is:

1. A package assembly comprising a rigid base member having at least one pair of parallel lines of weakening defining a tear strip, at least one row of packages positioned on the base member and removably secured to a tear strip by frangible adhesive, and a film of plastic material passing over the packages and secured to the base member to retain the packages in assembly therewith, the packages being removable from the assembly by removing the plastic film, tearing the tear strip from the remainder of the base member, and separating the packages from the tear strip by breaking the frangible adhesive.

2. A package assembly according to claim 1 wherein there is a plurality of rows of packages and the base member has a plurality of tear strips, each tear strip extending beneath a respective row of packages.

3. A package assembly according to claim 1 wherein the packages are removably secured to the base member by spots of frangible adhesive.

4. A package assembly according to claim 1 wherein the film provides an imperforate covering over the packages to resist entry of dust or dirt.

5. A package assembly according to claim 1 wherein the base member is of fibrous material, and the adhesive has greater adherence to the fibrous material than to the packages to cause substantially all the adhesive to remain adherred to the tear strip when the packages are removed therefrom.

6. A package assembly according to claim 1 wherein each package has superposed folded over portions at the bottom, the lowermost portion having an aperture exposing an adjacent portion and the tear strip having a partially cutout portion secured by adhesive to the bottom of each package over the aperture, each partially cut-out portion separating from the remainder of the tear strip when the associated package is separated therefrom and remaining attached to the bottom of the package.

7. A package assembly according to claim 1 wherein each package has superposed folded over portions at the top, an uppermost of said portions having a slot exposing an adjacent portion, a spot of thermoplastic material having been deposited in the slot to engage the adjacent portion and also overlapping at least one side edge of the slot to engage the uppermost portion.

* * * * *